United States Patent [19]

Riekkinen

[11] 4,431,293

[45] Feb. 14, 1984

[54] FILM DEVELOPING APPARATUS INCLUDING A SERIES OF PROCESSING TANKS AND MEANS FOR INDICATING AND CONTROLLING LOCATION OF FILM THEREIN

[76] Inventor: Martti O. Riekkinen, SF-70870 Hiltulanlahti, Finland

[21] Appl. No.: 264,039

[22] Filed: May 15, 1981

[51] Int. Cl.[3] ..... G03D 3/04; G03D 3/10

[52] U.S. Cl. ..... 354/322; 354/328; 134/76

[58] Field of Search ..... 354/297, 316, 320, 322; 134/56 R, 76; 198/342

[56] References Cited

U.S. PATENT DOCUMENTS

| | | | |
|---|---|---|---|
| 2,542,830 | 2/1951 | Newton et al. | 134/76 |
| 2,920,548 | 1/1960 | Copenhefer | 134/76 |
| 2,933,032 | 4/1960 | Pardee | 134/76 |
| 3,144,030 | 8/1964 | Donovan | 134/76 |
| 3,225,675 | 12/1965 | Cross et al. | 134/76 |
| 3,241,473 | 3/1966 | Hope et al. | 354/322 |
| 3,353,470 | 11/1967 | Zane | 354/322 |
| 3,559,553 | 2/1971 | Buechner | 354/322 |
| 4,208,119 | 6/1980 | Bate et al. | 354/322 |

FOREIGN PATENT DOCUMENTS

| | | | |
|---|---|---|---|
| 632043 | 11/1949 | United Kingdom | 354/320 |

*Primary Examiner*—A. A. Mathews

*Attorney, Agent, or Firm*—Andrus, Sceales, Starke & Sawall

[57] ABSTRACT

Developing apparatus mainly for the developing of films, comprising developing tanks (1–9), hangers (11) for films, transporting means (13–15) for transporting the hangers into register with the developing tanks, and a control unit (16) with clock unit (17), said control unit being arranged to control the transporting means with the aid of the clock unit. The apparatus has provided with separate tank switches (18) in register with the tanks (1–9), these switches having been arranged to cooperate with the hangers (11) under their control, and with a display unit (19) which has been connected with the tank switches and arranged to indicate those hangers which are in the tanks, and that the clock unit is adjustable so that the staying time of the hangers can be regulated. The tank switches (18) consist preferably of magnetic switches, and each hanger (11) has been provided with a magnet (19*a*) so that the magnet becomes positioned in the immediate vicinity of the respective tank's switch when the hanger is suspended in register with the respective tank. The magnetic switches (18) have preferably been mounted within a substantially enclosed protective cover (20).

5 Claims, 9 Drawing Figures

FILM DEVELOPING APPARATUS INCLUDING A SERIES OF PROCESSING TANKS AND MEANS FOR INDICATING AND CONTROLLING LOCATION OF FILM THEREIN

BACKGROUND OF THE INVENTION

Film developing apparatus known in the art is not applicable in developing overexposed or underexposed films so that the overexposure or underexposure could be corrected by a shortened, or prolonged, first development, as is well known from film development accomplished individually by manual operation. The film developing apparatus of prior art is not proper either if one should wish to prolong the final washing step, which improves the permanence of the film. The drawbacks mentioned are due to the circumstance that the transport of films in the consecutive developing tanks takes place with the aid of film transporting means, simultaneously, whereby if the developing time, respectively the rinsing time, of the films in any one tank, for instance in the first development tank or in the final washing tank, were prolonged and/or reduced this would also cause a change in the treatment times of the films in the other tanks, e.g. of the colour developing. It is thus understood that automated film developing devices of the prior art are only fit for film developing in a unitary way; and they cannot be used to develop films which require special developing or handling conditions and times. Underexposed and overexposed films as well as other films requiring special treatment have to be developed, nowadays, in that the machine is emptied of all films that have to be normally developed, whereafter the machine is adjusted in accordance with the said requirement and the special developing is carried out. Finally, the machine is readjusted for the original developing schedule.

SUMMARY OF THE INVENTION

The object of the invention is to eliminate the drawbacks mentioned. The object of the invention is to provide a developing apparatus which is appropriate for film developing in such manner that films requiring special developing and/or washing and/or treatment times, such as overexposed and underexposed films, can be developed simultaneously with films requiring normal developing conditions. It is especially an object of the invention, to provide a developing apparatus which is appropriate for simultaneous, automatic developing of overexposed and underexposed as well as normally exposed films so that each film may be developed in a manner consistent with special requirements, if desired. The advantages gainable by means of the invention will become apparent from the description following below, wherein the invention is described in detail with the aid of embodiment examples, with reference to the attached drawings, wherein:

DESCRIPTION OF THE ILLUSTRATED EMBODIMENT

Figure 1:
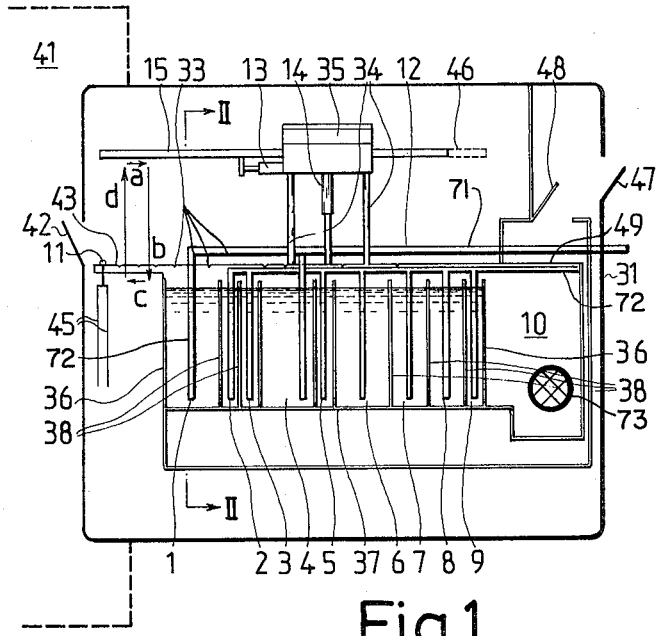
FIG. 1 presents, in elevational view, and schematically, a developing apparatus according to the invention.
Figure 2:
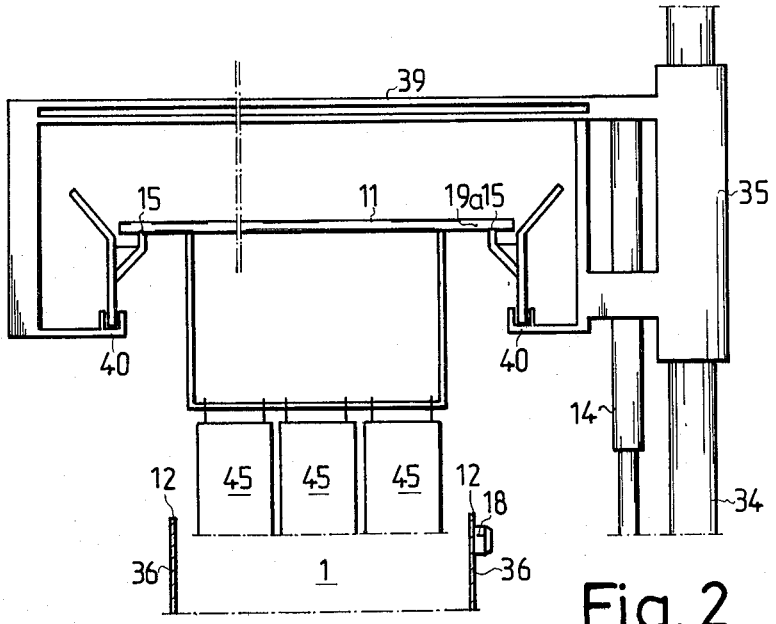
FIG. 2 shows the developing apparatus of FIG. 1, sectioned along the line II—II.

Referring now to FIGS. 1 and 2, the fully automatic colour slide film developing apparatus comprises the following developing tanks disposed one after the other, contiguous to each other: first developing tank 1, rinsing tank 2, replacement rinsing tank 3, colour developing tank 4, freshening tank 5, bleaching tank 6, fixing tank 7, rinsing tank 8 and final washing tank 9, and drying space 10. Each tank in the set of consecutively disposed tanks has a length which is an integer multiple of that of the shortest tank; tanks 2, 3, 5 and 9 all are equally long and they are the shortest among the tanks; tanks 7 and 8 have a length twice that of the tanks just mentioned, and tanks 1, 4 and 6 have a length three times that of the first-mentioned tanks (in FIG. 1, in elevational view, from left to right). The apparatus further comprises a suspension frame 12 disposed on both sides rims of the tanks, the films being suspended by hangers 11 to be carried by this frame. The apparatus further comprises transporting means 13–15 for transporting the hangers into position over the respective developing tanks and, respectively, the drying space, carried by the suspension frame, and a control unit 16 with clock or timing means 117 (visible in FIGS. 5, 6), the control unit being arranged to control the transporting means and the whole process with the aid of the clock means. According to the invention, on the suspension frame 12 separate tank switches 18 have been installed in register with the tanks 1–9, the switches being disposed to cooperate with the hangers 11 under their influence and control. Furthermore, the apparatus comprises a display unit 19 (visible in FIGS. 5, 6 and 8) connected to the tank switches and arranged to display the hangers lodged in the tanks. Furthermore, the clock unit is so adjustable that the time when the hangers stay in conjunction with the tanks 1–9 is adjustable, that is, the operation of the transporting means 13–15 transporting simultaneously all hangers carried by the suspension frame 12, together with their films, is timed and adjustable.

In the embodiment of FIGS. 1–2, the developing tanks consist of an elongated tank unit confined by side walls 36 and a bottom 37 and divided by partitions 38 into developing tanks. The suspension frame 12 consists of the side rim of the tank unit, where notches 33 have been provided for the hangers 11, the number of notches in connection with each tank being proportional to the tank lengths—in other words, for instance, on the apparatus length occupied by the first development tank 1, which has a length of three units, three notches have been provided, while there is one notch in conjunction with the rinsing tank 2, the length of which is one unit.

The film transporting means 13–15 comprise two parallel transport rails 15 extending all over the tanks in their longitudinal direction and disposed on the sides of the tanks, immediately outside the suspension frame 12. The transporting rails 15 are carried by carrier arms 39 affixed to a lift slide 35, the latter being mounted movably upward and downward along two stationary, vertical guide columns 34. The transport slide 15 has been provided with a power means, such as e.g. a lifting cylinder 14 operated with the aid of a pressurized fluid for lifting and lowering the slide with carrier arms 39 and transport rails 15. The transport rails 15 have been connected with each other and provided with a drive, such as e.g. a transport cylinder 13, operated with the aid of a pressurized fluid, for moving the rails with reference to the tanks 1–9, in the longitudinal direction of these tanks. The transport rails 15 have been mounted to be movable in their longitudinal direction, carried by slide rails 40, which are stationary with reference to the lift slide 35. The transporting of films into the developing tanks, and between tanks, is accomplished as described below.

When starting the developing process, the films 45 are transported manually to be within the walls 31 of the developing apparatus, from the room 41 e.g. through a hatch 42, and they are hung up on the ends 43 of the suspension frame 12 projecting to be positioned in front of the first developing tank 1, whereafter the process is commenced by starting the control unit 16. Next, the transporting cylinder 13 moves the transport rails 15 forward into the position reproduced with dotted lines 46, indicated by an arrow, step a, and the lift cylinder lowers the transport rails by mediation of the lift slide 35 down to position the transport rails on the sides of the suspension frames 12 constituting the side rims of tanks 1–9 in their immediate adjacence outside the tanks, step b. Next, the transporting cylinder 13 moves the transport rails in the direction towards the front ends 43 of the support frame 12, whereby the transport rails are carried in under the ends of the film hanger 11 projecting outside the support frame, step c, whereafter the left cylinder 14 lifts up the transport rails and the film hanger with films, remaining thereupon in the lifting step, step d. Finally, the transport rails move the film in the direction towards the tanks, step a, lower it down on support by the suspension frame 12, step b. This results in a stepwise transport of the film hanger 11 with film 45, first into the first development tank 1, then into the rinsing tank 2, etc., through the whole developing process. New films may continuously be introduced to be borne by the ends 43 of the suspension frame, and as the process proceeds, these films are carried into and through the process, as described. There are simultaneously in the process, as usual in the art, several hangers 11 with films, for instance three films in each hanger, one hanger in each notch of the hanger frame, which number 22, that is 66 films all told. After the developing steps, the films are carried on the extensions 49 of the hanger frame 12 into the drying space 10, whence the films may after completed drying be removed through doors 47 and 48. The control unit 16 has been arranged to control the transporting means 13–15 in such manner that the transporting means operate (that is, stepwise displacing of the hangers 11 takes place) at constant time intervals. The differences in developing times in the different tanks have been taken into account in fixing the tanks' lengths, so that the times of stay in each tank are proportioned as the lengths of the tanks, these latter being in the ratio of integer numbers. The displacement of the transporting means 13–15, that is the displacement of the films 45 in each displacement step, equals that unit length of which the tank lengths are integer multiples.

The developing of the films takes place in the tanks 1–9 with the aid of liquids pre-introduced into them. The liquids may be agitated in the first developing 1 and in the colour developing 4 by conducting via a suitable known feed tube 71 into said tanks an inactive gas, such as nitrogen for instance, and in the rest of the tanks via a suitable known feed tube 72 by conducting into the respective tanks another gas, such as air for instance. The temperature regulation, i.e. thermostating, of the tanks within desired temperature limits e.g. within $+0.2°$ C. is accomplished with the aid of conventional thermostats and heaters, potentially in combination with mixing pumps. The drying in the drying space 10 is accomplished e.g. with conventional air blowing as by a suitable blower unit 73.

In FIG. 2 can be seen a separate tank switch 18 mounted on the suspension frame 12 in register with the first developing tank 1, this switch being arranged to cooperate with the hanger 11 under control by the hanger. Thereby, when the hanger 11 is lowered to rest upon the hanger frame 12, the hanger frame actuates the switch 18, and the switch has been connected with the display unit to indicate the hanger which is in register with the respective switch, for instance by the aid of a pilot lamp, a digital display element or any conceivable display means. Hereby the developing apparatus indicates and displays those hangers (i.e., films) which are resting on the suspension frame 12, that is involved in the process, whereby the process operator may take into consideration the hangers (i.e., films) which participate in the process when he controls the process with the aid of the control unit 16 and/or the clock unit. Thus, for instance, if it is desired to develop an overexposed film with a developing time shorter than normal in order to correct the overexposure, the process operator will introduce this overexposed film into the developing apparatus so that the first developing of the film in tank 1 takes place over a period during which there are not other films in said first developing tank and/or the colour developing tank 4, whereby the reduced first developing time compensating for incorrect exposure has no substantial effect on the films which are in the other tanks at the same time. Similarly, an inadequate exposure time can be compensated for, when the apparatus of the invention is used, by increasing the length of first developing of this particular film, at the same time taking care that there are not other films in the first developing tank 1 and/or the colour developing tank 4, with the effect that the developing of the films in other tanks will not substantially suffer owing to the said, prolonged first developing. Furthermore, the permanence of any given film that is being developed may, when desired and e.g. on order by the customer, be improved by making the final washing in the final washing tank 9 last longer, after first checking in the display unit that there are no other films in the first developing tank 1 and/or the colour developing tank 4. It is thus understood that the tank switches according to the invention furnish a basis for individual film developing simultaneously with films which require conventional developing conditions. Furthermore, the switch arrangement of the invention provides the operator with exact and detailed information of the films involved in the developing process, to serve and aid the general organizing and programming of the developing work.

Figure 3:
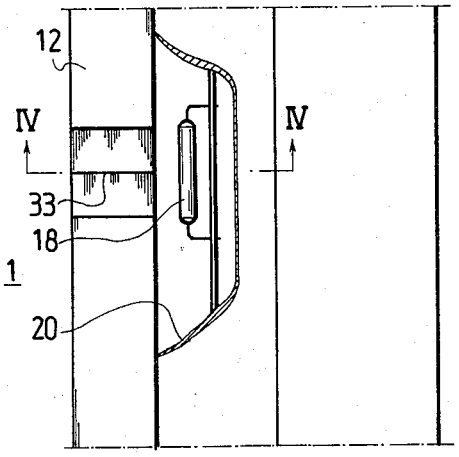
FIG. 3 presents, in top view, a tank switch belonging to the developing apparatus of FIGS. 1–2.
Figure 4:
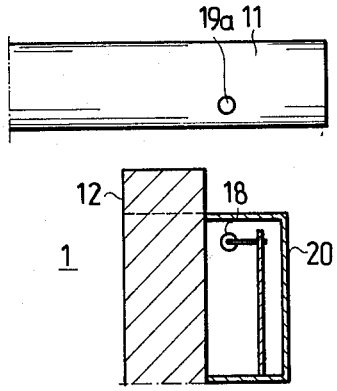
FIG. 4 shows the section along the line IV—IV in FIG. 3.

In FIGS. 3–4 has been depicted one of the three tank switches 18 installed in register with the first developing tank 1. The switch 18 is visible in FIG. 3 in top view, its closed protective cover 20 partly cut away in order to illustrate the construction. The switch has been disposed in register with the notch 33 of the film hanger 11 immediately adjacent thereto and outside the frame 12. The switch 18 is a magnetic switch, a so-called reed tube. FIGS. 2 and 4 reveal the magnet 19*a*, mounted on the end of the hanger 11 at a point corresponding to the location of the switch 18, controlling the operation of the switch 18; that is, this magnet actuates the switch. The switch 18 is enclosed within a sealed cover 20, of plastic for instance, with a view to protecting the switch against the developer chemicals.

Figure 5:
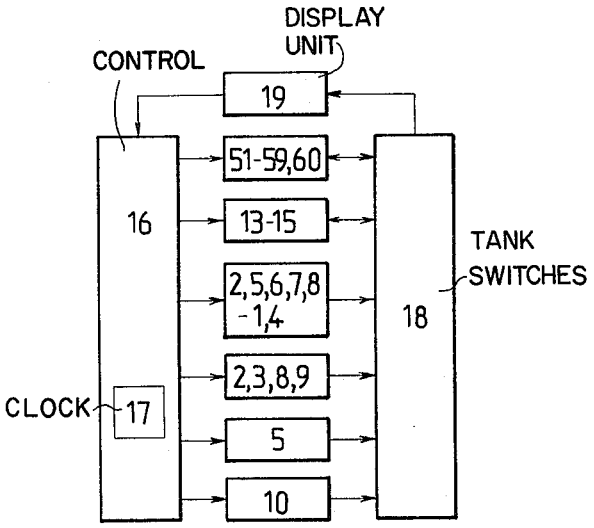
FIG. 5 presents the functional block diagram of the developing apparatus of FIGS. 1–4.

FIG. 5 shows the functional block diagram of the apparatus depicted in FIGS. 1–2. The control unit 16 has been arranged to control electrically the thermostating of tanks 1–9, that is, to supply the thermostats 51–59 of the tanks 1–9 and the thermostat 60 of the drying space 10 with their set-point values. Furthermore, the control means controls the operation of the transporting means 13–15 under control by the clock unit 17; similarly, the control unit controls the mixing in the tanks 1 and 4 by conducting nitrogen gas into these tanks, and in tanks 2, 5, 6, 7 and 8 by conducting air into these tanks. Furthermore, the control unit 16 controls the rinsing in tanks 2, 3, 8 and 9. Furthermore, the control unit 16 controls the freshening in the tank 5 and the air heating and warm air blowing in the drying space 10. Regarding the process monitoring, the figure only depicts the operation of the display unit 19, based on the operation of the tank switch 18; the process thermostating, that is the displacing, moving, rinsing, freshening and drying of the films take place in conventional way.

Figure 6:
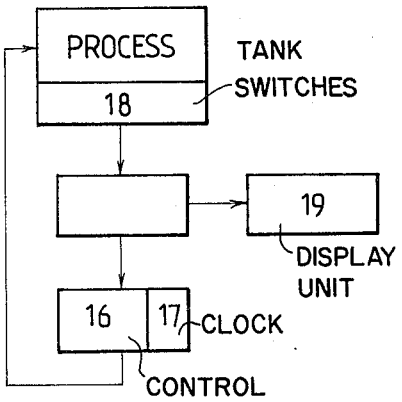
FIG. 6 illustrates the monitoring of the operating process of an apparatus as shown in FIGS. 1–4, in the form of a block diagram.

In FIG. 6 is shown the block diagram of the process monitoring with the aid of the tank switches 18, and the transferring of the information supplied by them, to the display unit 19 and the control unit 16.

Figure 7:
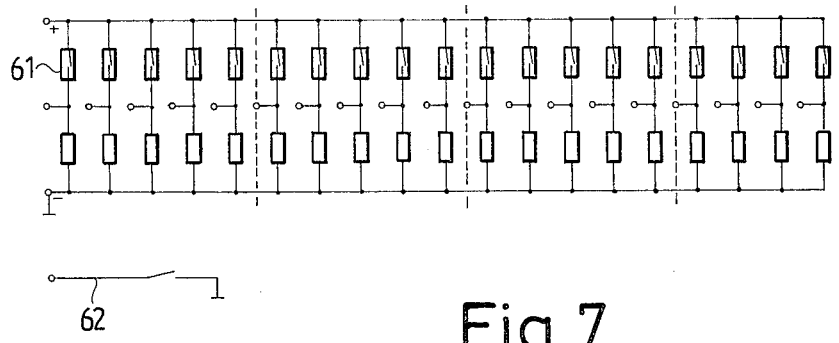
FIG. 7 shows the circuit diagram of the tank switches of an apparatus as shown in FIGS. 1–4.

FIG. 7 shows the circuitry of the tank switches linking them with the tanks 1–9. The figure moreover shows the starting switch 61 disposed on the initial end of the suspension frame 12, and the alarm signal switch 62 disposed in conjunction with the final rinsing.

Figure 8:
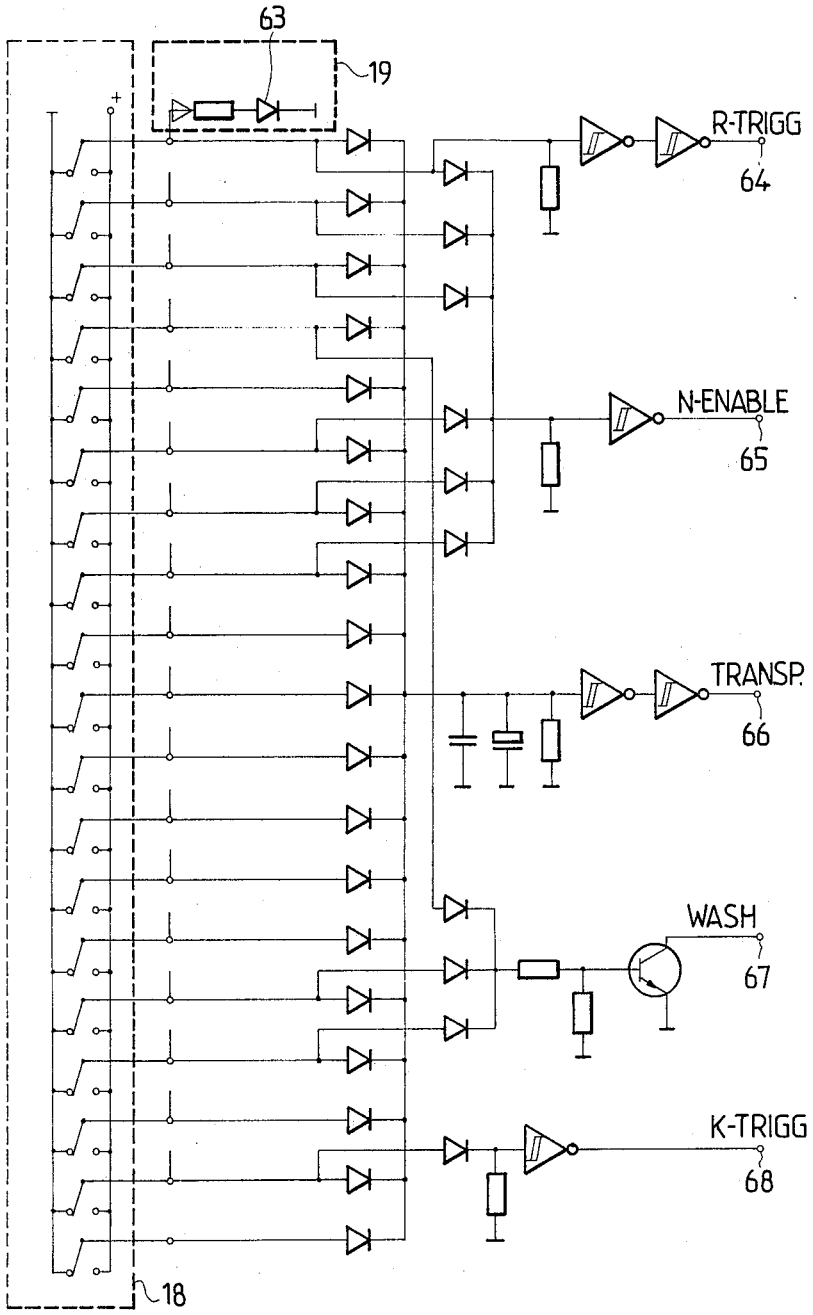
FIG. 8 shows the circuit diagram of the tank switches display unit, and the control of the developing conditions by means of the tank switches.

FIG. 8 shows the circuit in which the tank indicators 63 of the tank switches 18 have been combined in the display unit 19 (the indicators being shown for the first tank switch only, in order to simplify the figure and to make it more perspicuous). The figure further shows the control circuit 65 of the nitrogen gas mixer of tanks 1,4 for opening the magnetic valve admitting nitrogen gas from a pressure tank into said tanks then and only then when there are films undergoing developing in said tanks; at all other times the control circuit close the valve leading nitrogen gas into the tanks. The figure further shows the control circuit 66 which indicates the film hangers carried on the suspension frame and which to the control unit 16 supplies a signal enabling the operation of the transporting means under control by the control unit and by the clock unit. Furthermore, the figure shows the control circuit 67 controlling the flushing of tanks 4,8, i.e., starting the flushing under control by the respective tank switches. Furthermore, the figure shows the circuit 68, operating under control by the tank switch 18 mounted in conjunction with the stabilizing tank, for starting the drying blower and heater.

Figure 9:
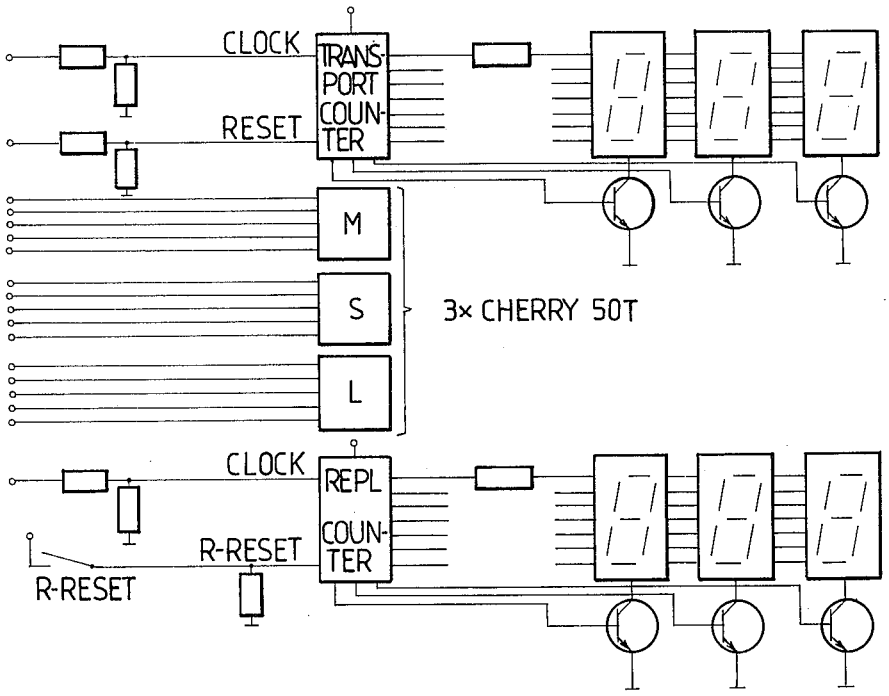
FIG. 9 shows the circuit diagram of the clock unit.

FIG. 9 shows the circuit of the control unit 16 and clock unit 17, with setting means.

I claim:

1. An apparatus for developing films, comprising a series of developing tanks, a drying area located adjacent said tanks, a film suspension frame disposed adjacent said tanks, a plurality of hangers for suspending films from the frame, transporting means for transporting the hangers into registry with said tanks, and, respectively, the drying area, a control unit including timing means, said control unit being operably connected to the transporting means for controlling movement of said transporting means and operable to step move the transporting means a given length for each actuation of said control unit, said plurality of developing tanks being constructed of different lengths in the direction of movement of said transporting means whereby the films are processed in different tanks for different total times, separate switch means associated with each of said tanks, said switches being arranged to be actuated by hangers located at the respective tanks, and a display unit operably connected with said switch means and arranged to indicate those hangers that are disposed in the respective tanks, said timing means being adjustable so that the residence time of the hangers in the tanks can be controlled.

2. The apparatus of claim 1, characterized in that the switch means consists of a plurality of magnetic switches, each hanger including a magnet positioned so that the magnet will be located in the immediate vicinity of the respective magnetic switch when the hanger is suspended in registry with the corresponding tank.

3. The apparatus of claim 2, characterized in that the magnetic switches are mounted within substantially enclosed protective covers.

4. The apparatus of claim 1, wherein said series of tanks includes a first developing tank and a second color developing tank, and said apparatus also includes nitrogen gas mixing means for said first and second developing tanks, said switch means associated with said first and second developing tanks being operably connected to the mixing means of the respective tanks to control the operation of the mixing means of said respective tanks.

5. The apparatus of claim 1, and including drying means disposed in said drying area, said apparatus also including dryer switch means operably connected to said drying means and disposed in said drying area and arranged to cooperate with the hanger suspended in said drying area to control the operation of said drying means.

* * * * *

UNITED STATES PATENT AND TRADEMARK OFFICE

CERTIFICATE OF CORRECTION

PATENT NO. : 4,431,293

DATED : February 14, 1984

INVENTOR(S) : Martti O. Riekkinen

It is certified that error appears in the above-identified patent and that said Letters Patent are hereby corrected as shown below:

Col. 1 Line 54, After "desired" insert a new paragraph

Col. 2 Line 39, After "means" "117" should be ---17---

Col. 3 Line 8, After "transport" "slide 15" should be ---slide 35---

Col. 4 Line 44, After "are" cancel "not" and substitute therefore ---no---

Col. 4 Line 52, After "are" cancel "not" and substitute therefore ---no---

Col. 5 Line 56, After "circuit" cancel "close" and substitute therefore ---closes---

Signed and Sealed this

*Twelfth* Day of *February 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,431,293

DATED : February 14, 1984

INVENTOR(S) : MARTTI O. RIEKKINEN

It is certified that error appears in the above-identified patent and that said Letters Patent are hereby corrected as shown below:

Col. 4, line 11, after "tanks" delete "via a suitable known feed tube 72"; Col. 4, line 13, after "tanks" delete "via a suitable known feed tube 72"

Signed and Sealed this

*Seventh* Day of *May 1985*

[SEAL]

*Attest:*

DONALD J. QUIGG

*Attesting Officer* *Acting Commissioner of Patents and Trademarks*